US005507387A

United States Patent [19]

Fiebig et al.

[11] Patent Number: 5,507,387

[45] Date of Patent: Apr. 16, 1996

[54] FOLDABLE BOX FOR PACKAGING OF AN ELECTRIC LAMP

[75] Inventors: Werner Fiebig, Munich; Helfried Koertel, Friedberg, both of Germany

[73] Assignee: Patent-Treuhand-Gesellschaft Fuer Elektrische Gluehlampen mbH, Munich, Germany

[21] Appl. No.: 376,760

[22] Filed: Jan. 23, 1995

[30] Foreign Application Priority Data

Feb. 2, 1994 [DE] Germany ..... 9401893 U

[51] Int. Cl.[6] ..... B65D 85/42

[52] U.S. Cl. ..... 206/418; 206/45.14

[58] Field of Search ..... 206/418, 45.14, 206/591

[56] References Cited

U.S. PATENT DOCUMENTS

| | | | |
|---|---|---|---|
| Re. 23,670 | 6/1953 | Currivan | 206/418 X |
| 1,077,751 | 11/1913 | Pribnow | 206/418 |
| 1,250,770 | 12/1917 | Beach | 206/418 X |
| 1,343,002 | 6/1920 | Markert | 206/418 |
| 4,159,076 | 6/1979 | Engdahl, Jr. . | |
| 4,200,192 | 4/1980 | Klomp | 206/418 |
| 4,260,059 | 4/1981 | Roccaforte | 206/418 X |
| 4,921,099 | 5/1990 | Trauschke | 206/418 |

FOREIGN PATENT DOCUMENTS

| | | | |
|---|---|---|---|
| 676550 | 8/1966 | Belgium . | |
| 1067305 | 6/1954 | France . | |
| 0074903 | 1/1961 | France | 206/418 |
| 2354251 | 1/1978 | France . | |
| 1027590 | 4/1958 | Germany . | |
| 8414328 | 12/1986 | Germany . | |
| 9002106 | 4/1992 | Netherlands . | |

*Primary Examiner*—Paul T. Sewell
*Assistant Examiner*—Ted Kavanaugh
*Attorney, Agent, or Firm*—Frishauf, Holtz, Goodman, Langer & Chick

[57] ABSTRACT

To retain an electric lamp in position within the box, in which the electric lamp has a base with projecting terminal pins (21), in such a manner that the pins (21) cannot push through and extend from the box. The box is formed with dust flaps (10, 11) which are folded inwardly to form an essentially triangular, inwardly extended projection or bridge. The so folded dust flaps (10, 11) are formed at their free ends with interengaging teeth and recesses, the interengaging apex of the triangular support structure engaging against the base (20*a*) of the lamp and forming a corner with one of the sidewalls (3) in which the pins (21) from the lamp (20) can fit, while the lamp itself is securely retained in immovable position of the box. The angle of the dust flaps (10, 11) with respect to the adjacent sidewalls (1, 3) can suitably vary within about 45 and 70 degrees.

12 Claims, 2 Drawing Sheets

FIG. 2
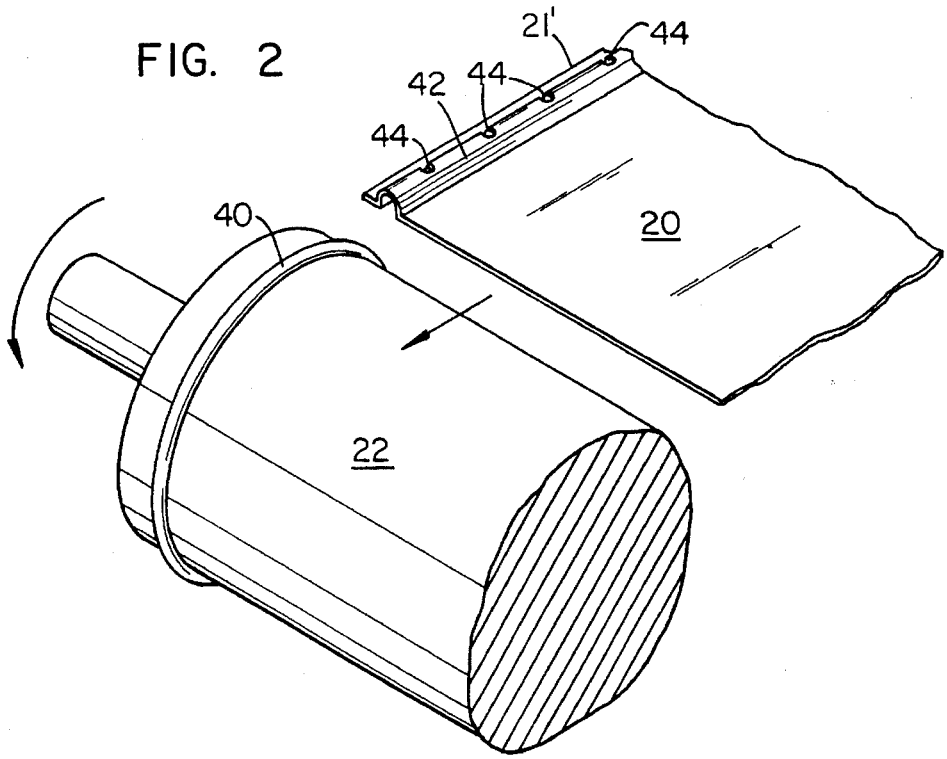
FIG. 3
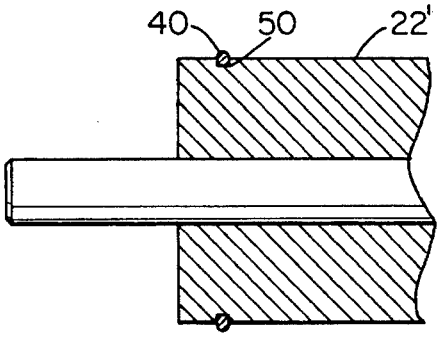
FIG. 4
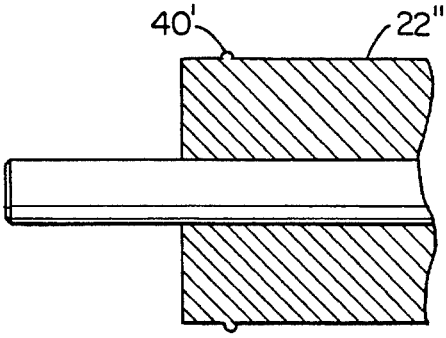
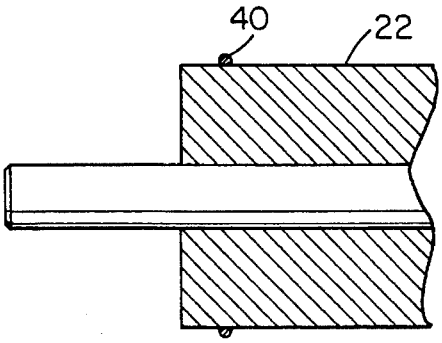
FIG. 5

FOLDABLE BOX FOR PACKAGING OF AN ELECTRIC LAMP

Reference to related patent, the disclosure of which is hereby incorporated by reference: U.S. Pat. No. 4,200,192, Klomp.

FIELD OF THE INVENTION

The present invention relates to a folded box, erected from a blank, and specifically adapted to retain an electric lamp therein, and especially a lamp of the type which has an enlarged bulbous portion, such as a reflector-type lamp, from which a narrowed base extends.

BACKGROUND

General service lamps are usually packaged in essentially quadratic boxes which are constructed of a blank, suitably formed with wall panels which, when folded and erected, form the box. The blank, usually, is a single unitary cardboard element which has four sidewalls, a top flap, usually supplied with an insertion or holding flap, and a bottom flap which, likewise, may have an insertion or holding flap. Additionally, a pair of dust closing flaps may be provided, one each at the side of the top cover and at the bottom, respectively. The flaps to keep out dust and the like are usually integrally formed with oppositely located sidewalls; when the box is erected and closed, they overlap.

Boxes of this kind are suitable for various types of lamps and particularly for those having screw or bayonet-type bases; if the bases of the lamps, however, are formed with projecting terminal pins, such boxes are not suitable since the lamp pins can penetrate the cardboard of the boxes and, when projecting from the boxes, can be damaged while further damaging the box by tearing of the material thereof. Consequently, neither the lamp, nor the box are sufficiently protected against damage when being transported or otherwise handled.

U.S. Pat. No. 4,200,192 Klomp describes a box which is essentially of quadratic shape and formed of a single, unitary blank, designed to retain a reflector-type lamp with a screw-in base thereon. The box has four sidewalls which form a sleeve open at its ends. The closing structures at the ends are identical and are formed by four top cover flaps and four bottom flaps, respectively. Each one of the four top or bottom flaps, respectively, is integral with one of the sidewalls. Two oppositely located top or bottom flaps, respectively, are identical and form a pair. Both flaps of one of the top or bottom flap pair, respectively, are formed with additional fold or crease or score lines which are at an inclination with respect to the common folding edge between the respective flap and the corresponding sidewall. These creases can form, on the cover or bottom flap pairs, respectively, backwardly directed flap portions, that is, flap portions folded against themselves, which extend within the folding box in order to retain the lamp, to be placed in the box within the box structure itself. The other pair of the top or bottom flaps cover, respectively, closes the open ends at the top and bottom.

It has been found that this type of box is comparatively expensive and difficult to make.

THE INVENTION

It is an object to provide a box which is easily made and which uses a minimum of packaging material while adequately supporting and retaining an electric lamp therein, and which is particularly suitable for retaining a lamp with projecting terminal pins, while protecting the pins of the lamp and preventing inadvertent penetration of the box material by the pins.

Briefly, the box, as is customary, has four sidewalls which, when the box is erected, leave an open top and an open bottom. The top and bottoms are closed by top and bottom flaps, respectively. Thus, flaps folded within the interior of the box are also provided.

In accordance with a feature of the invention, dust flaps are located beneath the top flaps which are formed at their ends with interengaging projection-and-recesses and are so dimensioned that when folded inwardly of the box, form an angle less than 90° with the adjacent sidewall to which they are unitarily hinged. A suitable angle is, for example, in the order of about 45°, although the angle is not critical and will depend on the lamp to be retained therein. When the box is erected, the two dust flaps will interlock with their projection-and-recess elements and form an inwardly extending bridge of, in cross-section essentially triangular shape, which bridges across the top, beneath the top flap, inwardly of the space of the erected box.

The inwardly extending bridge securely places a lamp within the box due to the angle between the bridge and the sidewalls, which defines a wedge-shaped space and provides a secure location for a base of the lamp, including projecting terminal pins.

The box is particularly suitable for packaging reflector-type lamps, with bases narrower than the lamp itself, and in which the lamp is located approximately diagonally within the box. A reflector lamp is so located therein that the opening of the reflector faces the bottom of the box, and a portion of the sidewall thereof, due to its diagonal location. The terminal pins of the lamps then extend into the corner formed by one of the dust flaps extending at an angle from the top and the unitary sidewall therewith. When the dust flaps are inter-engaged by their projection-and-recess arrangement, for example formed by a projecting tooth or projecting teeth, and depressions therebetween engaged by the teeth of the opposite flap, the bridge which is thereby formed will be sturdy, support the base of the lamp and additionally locate the lamp in a diagonal position within the box. The inter-engaged dust flaps thus protect the projecting and hence potentially bendable contact terminals or pins of the lamp against damage during transport while additionally preventing penetration of any portion of the box by the contact pins.

Preferably, the box in accordance with the present invention is made of recyclable material such as cardboard or corrugated cardboard. In the particularly preferred embodiment, the box is formed as a quadratic, folded, erected structure built up of a single, unitary, cardboard or corrugated paper blank. The direction of fibers of cardboard, or corrugation is preferable parallel to the height of the box, that is, extending between bottom and top. This insures excellent stability for the dust flaps.

In accordance with a preferred embodiment, the top is made of a top flap which is extended to form an insertion flap, coupled to the top flap by a crease or fold line. The insertion flap is formed with cuts at both sides, at the level of the folding edge extending at an inclination with respect to the folding edge, so that the insertion flap, upon closing of the top flap, can engage behind the dust flaps which extend from the adjacent sidewalls when the box is erected, at an angle inwardly of the box.

DRAWINGS

FIG. 1 is a plan view of a blank from which the box can be erected and illustrating the flaps and fold lines over which the flaps can be folded; and FIG. 2 is a vertical, cross-sectional view through the box erected from the blank of FIG. 1 and illustrating, highly-schematically, a reflector lamp with a pin-type base retained in the box.

DETAILED DESCRIPTION

Figure 1:
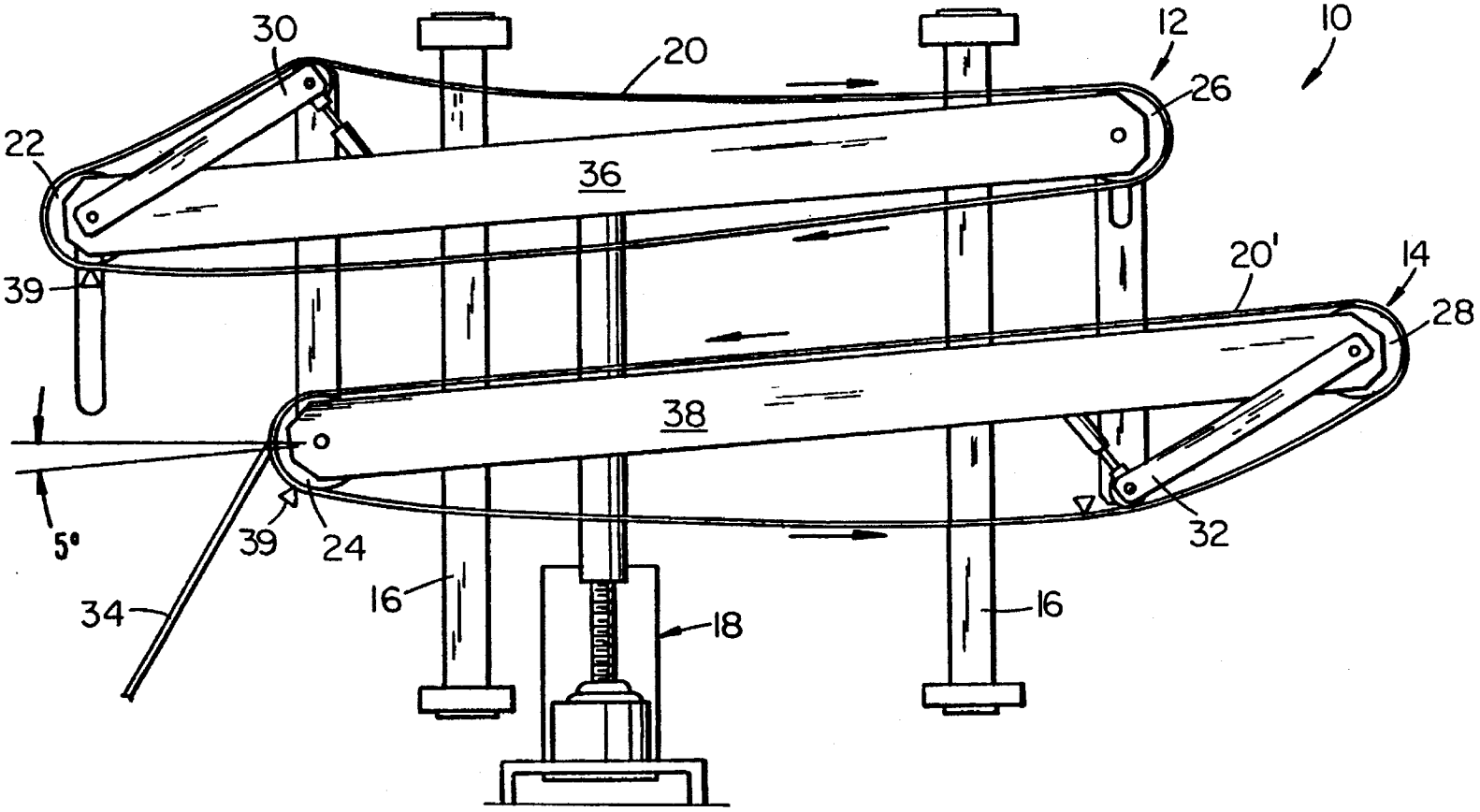
Figure 1:
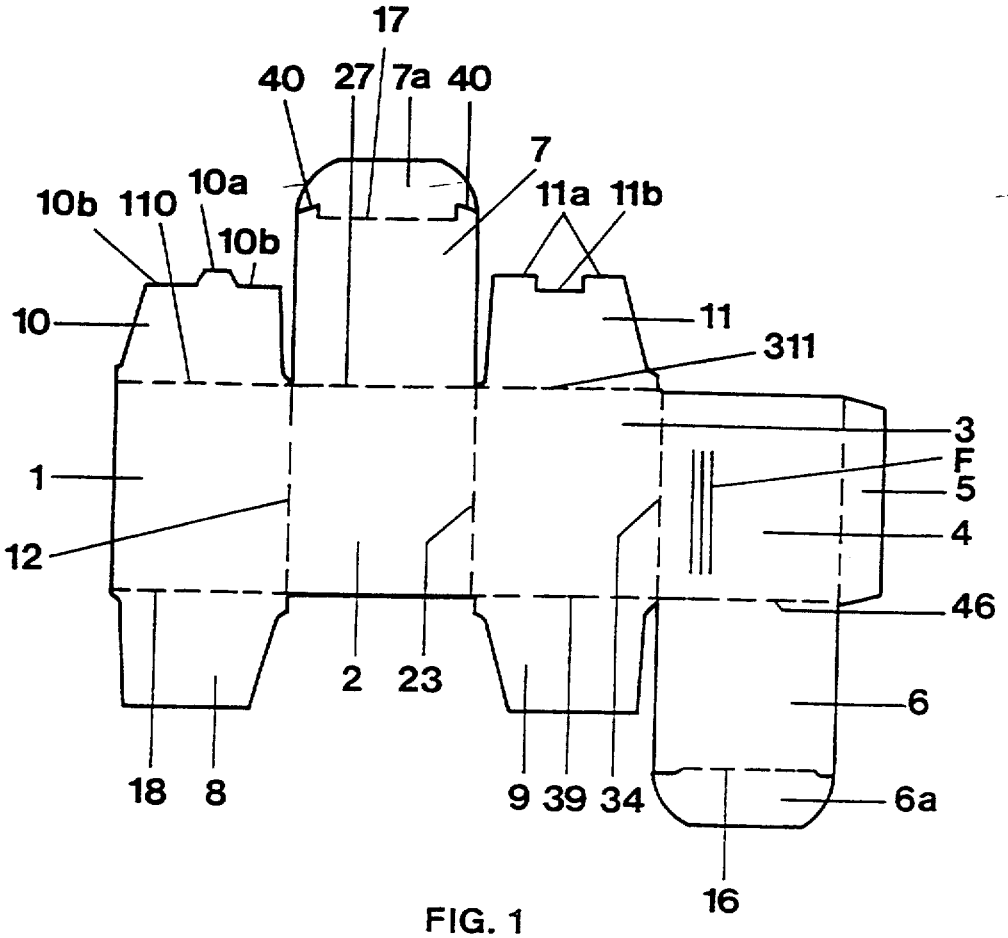

Referring first to FIG. 1, which illustrates the blank from which the box can be erected. Preferably, the blank is a single, unitary element made of cardboard or corrugated paperboard in which fibers or corrugations extend in the direction schematically indicated by the arrows F between the bottom and the top of the box when erected.

The blank has four interconnected sidewalls, 1, 2, 3, 4, separated by fold, crease or score lines 12, 23, 34. The fourth sidewall 4 has an insertion flap 5 attached thereto which is preferably coated with adhesive. Upon erection of the box, flap 5 fits within the box and is adhesively connected to the sidewall 1 to form the box structure (FIG. 2), with an open top and an open bottom. After the adhesive flap 5 is connected to sidewall 1, the four sidewalls form a tubular sleeve of rectangular cross-sections.

The open ends of the sleeve can be closed by a bottom flap 6 and a top flap 7. The top flap 7 is integrally secured to the upper end edge of the second sidewall 2 by a fold or crease line 27. The bottom flap 6 is connected to the sidewall 4 by a fold or crease line 46 at the lower end edge of the fourth sidewall. The top flap 7 as well as the bottom flap 6 have additional insertion flaps 6*a*, 7*a* connected at the ends thereof by fold or crease line 16, 17, respectively.

In accordance with a feature of the invention, the top insertion flap 7*a* is formed with two cuts 40, at the level of the folding edge between top flap and insertion flap, which extend at an inclination with respect to the folding edge.

The bottom of the box, additionally, is formed with two dust flaps 8, 9 which, when the box is closed, overlap each other. The dust flaps 8, 9 are connected over respective fold, crease or score lines 18, 39 to the respective sidewalls 1, 3. When the box is closed, see FIG. 2, they are covered by the bottom flap 6. The top side of the folding box also is formed with two dust flaps 10, 11.

In accordance with the present invention, the dust flaps 10, 11 are essentially trapeze-shaped and connected over respective fold lines 110, 311 to the edges at the ends of the sidewalls 1, 3, which face each other or are opposite each other when the box is erected. The free ends of the dust flaps 10, 11, are formed with an interfitting, interengaging projection-and-recess arrangement, which in the example shown is formed by teeth 11*a* on flap 11, separated by a recess 11*b*, and a tooth 10*a*, adjacent recesses 10*b* on the flap 10. When the box is erected and the flaps 10, 11 project towards each other, the teeth can inter-engage with the respective depression or recesses. The length of each of the two dust flaps 10, 11 is somewhat greater than half the spacing of the sidewalls 1, 3 from each other of the erected box, that is, more than half the width of the sidewalls 2, 4. The two dust flaps 10, 11, when the teeth and depressions 10*a*, 11*b*; 11*a*, 10*b* are inter-engaged, form a bridge which extends across the opening of the box at the top side. This bridge engages a portion or part of the lamp to support the lamp, in position within the box. The overall length of the bridge formed by the inter-locked dust flaps 10, 11 is greater than the spacing of the sidewalls 1, 3. When the top flap 7 is closed, the insertion flap 7*a* engages behind the dust flaps 10, 11, and the dust flaps 10, 11 engage in the cuts 40 formed in the top flap or, respectively, the insertion flap 7*a* where the top flap and the insertion flap meet at the crease line 17.

Figure 2:
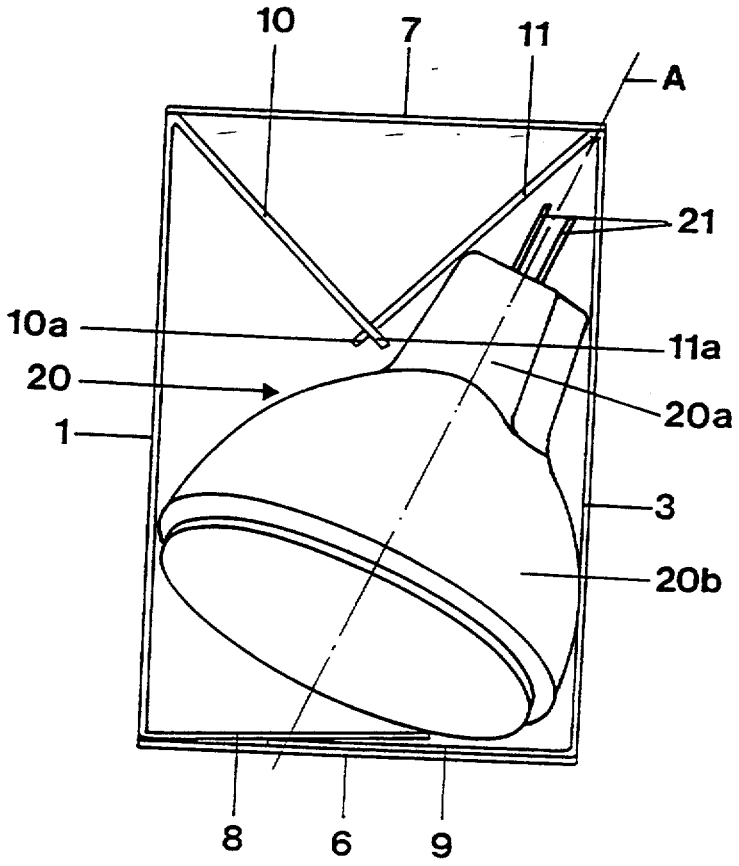

FIG. 2 illustrates the box when erected and, highly schematically, a reflector lamp 20 therein. The lamp or, rather, the axis A of the lamp is located at an inclination within the box, approximately diagonally therein. The lamp base, or neck 20*a* of the reflector lamp faces the top of the box. The dust flaps 10, 11 when inter-engaged, form an angle smaller than 90° with the respective sidewalls 1, 3 and define a bridge which crosses the opening of the box. This bridge locates and protects the base 20*a* or, respectively, the neck of the reflector 20*b* of lamp 20. Lamp 20, thus, is stabilized in its inclined position within the box, supported by multi-point engagement with the bottom dust flaps and wall 6, sidewall 1, sidewall. 3 and flaps 11. As can be seen, the contact pins 21 are located in the corner formed by one of the dust flaps 10, 11, in the embodiment Shown by dust flap 11, and the respective sidewall 3. Of course, the end of this corner space is closed off by the sidewalls 2, 4. The cover flap 71entirely covers the dust flaps 10, 11 after the box is closed.

Various changes and modifications may be made and the box of essentially square cross-section is selected only as an example. Furthermore, the top flap and/or the bottom flap need not be formed with an extended insertion flap 7*a*, 6*a*, but could be formed with an adhesive connection similar to the flap 9. It is also not necessary that the box is made from a unitary carton. The blank can be a multi-element structure; corrugated material as well as cardboard is suitable. The cross-sectional shape of the box also can be varied from that shown. For example, the box could be a cylindrical structure having six or eight sidewalls closed off at the end surfaces by a top and bottom flap, respectively, of suitable shape to close the entire opening. Again, the top side could be formed with interengaging dust flaps projecting from oppositely positioned sidewalls when the box is erected.

In the description, reference has been made to a top wall and a bottom wall. This, of course, is only of convenience of description since the position of the box once in use can be located at random. As can readily be seen, when the box, for example as shown in FIG. 2, is inverted by 180°, the pins 21 projecting from the base of the lamp will not penetrate any portion of the box since the base or the neck of the reflector, respectively, shown at 20*a*, is securely retained within the erected box by the flap 11 of the bridge, preventing slithering of the lamp within the box without directly engaging the projecting terminals 21 extending from the base or reflector neck.

The angle of the dust flaps (10, 11) with respect to the adjacent sidewalls (1, 3) can suitably vary within about 45 and 70 degrees.

We claim:

1. The combination of an electric lamp (20) having a bulbous portion (20*b*), a base portion (20*a*) and a connection terminal portion (21) extending from the: base portion (20*a*) with a folding box, said folding box having four sidewalls (1, 2, 3, 4), said sidewalls, when the box is erected, forming a hollow, polygonal structure, a bottom wall (6) and a top wall (7), which bottom and top walls close off the box at the bottom and top, respectively;

a first dust flap (10) integral with a first sidewall (1);

a second dust flap (11) integral with another sidewall (3) which, when the box is erected, is located opposite the first sidewall (1), wherein said first and second dust flaps (10, 11) are formed at their free edges with respective projection-and-recess means (10*a*, 11*b*; 11*a*, 10*b*) forming projecting teeth-like portions (10*a*, 11*a*) positioned adjacent depressed or recessed portions (10*b*, 11*b*) and, respectively, located on said first and second dust flaps, such that the projecting portions of one of said dust flaps engages the depressed or recessed portions of the other dust flap, each of said dust flaps (10, 11), when the box is erected, being folded into the inside of the box and forming an angle less than 90° with the respective sidewall (1, 3) on which Said dust flap (10, 11) is formed, said dust flaps, in the erected box, defining an inwardly extending, in cross-section essentially triangular, hollow rib, bridging the space inwardly of the erected box, and wherein one (11) of said dust flaps forming a side of said triangular bridge, together with an adjacent sidewall (3) of the box form a converging wedge-shaped corner defining an apex; and wherein said lamp is located within the box with the bulbous portion (20*b*) located beneath the apex of said essentially triangular bridge and said base portion (20*a*) and connecting terminal portion located in said corner, said dust flap (11) formed on said one sidewall (3) of the essentially triangular portion engaging against said lamp (20).

2. The combination of claim 1, wherein the surface length of said bridge is greater than the spacing of the oppositely located sidewalls (1,3) on which the dust flaps (10, 11) are formed.

3. The combination of claim 1, wherein said box is constructed from a unitary, single element blank.

4. The combination of claim 1, wherein said box is constructed of cardboard or corrugated board.

5. The combination of claim 1, wherein the direction of fibers or corrugations, respectively, of the box material extends parallel to a height of the box with respect to the bottom and top (6, 7) thereof.

6. The combination of claim 5, wherein said one dust flap (11) engages against the base portion (20*a*) of the lamp.

7. The combination of claim 5, wherein said terminal portion of the lamp comprises projecting terminal connection pins (21); and wherein said projecting terminal connection pins are received within said corner with clearance.

8. The combination of claim 7, wherein said one dust flap (11) engages against a base portion (20*a*) of the lamp.

9. The combination of claim 8, wherein the top comprises a top flap (7) covering over said dust flaps (10, 11) when the box is erected and closed.

10. The combination of claim 8, wherein the top comprises a top flap (7) formed with an insertion flap (7*a*) extending therefrom.

11. The combination of claim 1, wherein the cross-section of the box, measured parallel to the bottom or top, respectively, is essentially square.

12. The combination of claim 1, wherein the top comprises a top flap (7) formed with an insertion flap (7*a*) extending therefrom;

a fold or crease line (17) delimiting the insertion flap (7*a*) for bending or creasing the insertion flap with respect to the top flap;

and a cut (40) extending at an angle with respect to said fold or crease line (17) in which the insertion flap (7*a*) is engaged and located behind the dust flaps (10, 11).

* * * * *

UNITED STATES PATENT AND TRADEMARK OFFICE

CERTIFICATE OF CORRECTION

PATENT NO. : 5,507,387

DATED : April 16, 1996

INVENTOR(S) : FIEBIG et al.

It is certified that error appears in the above-indentified patent and that said Letters Patent is hereby corrected as shown below:

Title page should be deleted and substituted with the attached title page

In the Drawings: on Sheet 1 of 2 delete "FIG. 1".

on Sheet 2 of 2 delete "FIG. 2, FIG. 3, FIG. 4 and FIG. 5"

AND

Insert the Attached drawings.

Column 4, line 54 (claim 1), after "the", delete ":"

Column 5, line 10 (claim 1), "Said" should be --said--

Column 6, line 3 (claim 5), "a" should be --the--

Signed and Sealed this

Twenty-fourth Day of September, 1996

*Attest:*

Bruce Lehman

BRUCE LEHMAN

*Attesting Officer*

*Commissioner of Patents and Trademarks*

US005507387A

United States Patent [19]

Fiebig et al.

[11] Patent Number: 5,507,387

[45] Date of Patent: Apr. 16, 1996

[54] FOLDABLE BOX FOR PACKAGING OF AN ELECTRIC LAMP

[75] Inventors: Werner Fiebig, Munich; Helfried Koertel, Friedberg, both of Germany

[73] Assignee: Patent-Treuhand-Gesellschaft Fuer Elektrische Gluehlampen mbH, Munich, Germany

[21] Appl. No.: 376,760

[22] Filed: Jan. 23, 1995

[30] Foreign Application Priority Data

Feb. 2, 1994 [DE] Germany ..... 9401893 U

[51] Int. Cl.[6] ..... B65D 85/42

[52] U.S. Cl. ..... 206/418; 206/45.14

[58] Field of Search ..... 206/418, 45.14, 206/591

[56] References Cited

U.S. PATENT DOCUMENTS

| | | | |
|---|---|---|---|
| Re. 23,670 | 6/1953 | Currivan | 206/418 X |
| 1,077,751 | 11/1913 | Pribnow | 206/418 |
| 1,250,770 | 12/1917 | Beach | 206/418 X |
| 1,343,002 | 6/1920 | Markert | 206/418 |
| 4,159,076 | 6/1979 | Engdahl, Jr. . | |
| 4,200,192 | 4/1980 | Klomp | 206/418 |
| 4,260,059 | 4/1981 | Roccaforte | 206/418 X |
| 4,921,099 | 5/1990 | Trauschke | 206/418 |

FOREIGN PATENT DOCUMENTS

| | | | |
|---|---|---|---|
| 676550 | 8/1966 | Belgium . | |
| 1067305 | 6/1954 | France . | |
| 0074903 | 1/1961 | France | 206/418 |
| 2354251 | 1/1978 | France . | |
| 1027590 | 4/1958 | Germany . | |
| 8414328 | 12/1986 | Germany . | |
| 9002106 | 4/1992 | Netherlands . | |

*Primary Examiner*—Paul T. Sewell
*Assistant Examiner*—Ted Kavanaugh
*Attorney, Agent, or Firm*—Frishauf, Holtz, Goodman, Langer & Chick

[57] ABSTRACT

To retain an electric lamp in position within the box, in which the electric lamp has a base with projecting terminal pins (21), in such a manner that the pins (21) cannot push through and extend from the box. The box is formed with dust flaps (10, 11) which are folded inwardly to form an essentially triangular, inwardly extended projection or bridge. The so folded dust flaps (10, 11) are formed at their free ends with interengaging teeth and recesses, the interengaging apex of the triangular support structure engaging against the base (20a) of the lamp and forming a corner with one of the sidewalls (3) in which the pins (21) from the lamp (20) can fit, while the lamp itself is securely retained in immovable position of the box. The angle of the dust flaps (10, 11) with respect to the adjacent sidewalls (1, 3) can suitably vary within about 45 and 70 degrees.

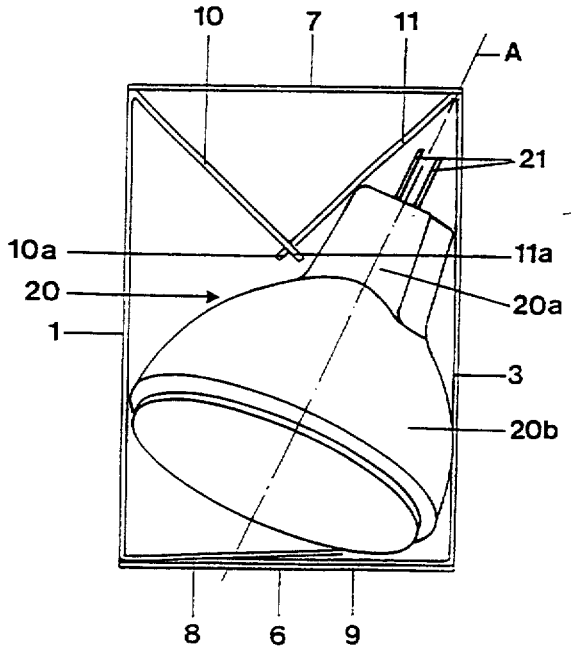

12 Claims, 2 Drawing Sheets